US008448934B2

(12) United States Patent
Chung et al.

(10) Patent No.: US 8,448,934 B2
(45) Date of Patent: May 28, 2013

(54) PAPER PICKUP STRUCTURE OF A PAPER FEEDING DEVICE WITH A LIMITING MEMBER LOCATED ON A ROTATING ARM

(75) Inventors: Ming-Chieh Chung, Taipei (TW); Po-Wen Tsai, Taipei (TW)

(73) Assignee: TECO Image System Co., Ltd, Taipei (TW)

( * ) Notice: Subject to any disclaimer, the term of this patent is extended or adjusted under 35 U.S.C. 154(b) by 35 days.

(21) Appl. No.: 13/175,996

(22) Filed: Jul. 5, 2011

(65) Prior Publication Data

US 2012/0098186 A1 Apr. 26, 2012

(30) Foreign Application Priority Data

Oct. 22, 2010 (TW) ..... 99136231 A

(51) Int. Cl.
*B65H 3/06* (2006.01)

(52) U.S. Cl.
CPC ..... *B65H 3/0669* (2013.01)
USPC ..... 271/114

(58) Field of Classification Search
USPC ..... 271/114, 109, 115, 116
See application file for complete search history.

(56) References Cited

U.S. PATENT DOCUMENTS 4,589,646 A * 5/1986 Ozawa et al. ..... 271/114
5,435,539 A * 7/1995 Namiki ..... 271/114
5,823,523 A * 10/1998 Park ..... 271/116

* cited by examiner

*Primary Examiner* — Gerald McClain
(74) *Attorney, Agent, or Firm* — Rabin & Berdo, P.C.

(57) ABSTRACT

A paper pickup structure of a paper feeding device is provided. The paper pickup structure includes a rotating arm, including a connection portion, a base, and a combination member, in which the connection portion and the combination member are located on the base, a first gear, combined with the connection portion to be switched between a forward rotation state and a reverse rotation state, so as to drive the rotating arm to rotate, a limiting member, located on the rotating arm, in which one end of the limiting member is combined with the combination member of the rotating arm, or one end of the limiting member is separated from the combination member through the rotation of the rotating arm, a second gear, located on the base, and a third gear, driven by the second gear to rotate when the rotating arm rotates to a predetermined position.

8 Claims, 10 Drawing Sheets

PAPER PICKUP STRUCTURE OF A PAPER FEEDING DEVICE WITH A LIMITING MEMBER LOCATED ON A ROTATING ARM

CROSS-REFERENCES TO RELATED APPLICATIONS

This non-provisional application claims priority under 35 U.S.C. §119(a) on Patent Application No. 99136231 filed in Taiwan, R.O.C. on Oct. 22, 2010, the entire contents of which are hereby incorporated by reference.

BACKGROUND

1. Technical Field

The present invention relates to a paper pickup structure, and more particularly to a paper pickup structure of a paper feeding device.

2. Related Art

With the change of technology each passing day, office machines associated with computer peripherals, such as printers, photocopiers, scanners, and fax machines, can help improve information processing efficiency, and are therefore increasingly popular. Furthermore, with the development of multi-functional machine technology, more and more office machines have faxing, scanning, photocopying, and printing functions. Office machines not only have multiple word processing capabilities, but have also become lighter. Moreover, their assembly steps are simple, and they can be used in conjunction with just a computer by connection to a telephone line, a network line, and a power line. As a result, office machines have become increasingly popular.

An Automatic Document Feeder (ADF) or a Re-Circulating ADF (RADF) is installed in an office machine such as a printer, photocopier, scanner, or fax, and is used to feed a stack of paper to be processed into the main body of the machine for processing one by one. In a paper pickup mechanism of the conventional RADF, an electronic clutch is mostly used to control a paper pickup time of a next manuscript during double-sided scanning, which is convenient, but too costly. In addition, a heat fade problem may occur in the conventional paper pickup mechanism due to long-time use, and burning may even be caused. Furthermore, the use of the conventional paper pickup mechanism may increase the power of the machine, and thus a design purpose of low power requirements for modern products cannot be achieved.

SUMMARY

In view of these difficulties, the present invention provides a paper pickup structure of a paper feeding device, which includes: a rotating arm, including a connection portion, a base, and a combination member, in which the connection portion and the combination member are respectively located on two sides of the base; a first gear, combined with the connection portion and driven by a driving module to be switched between a forward rotation state and a reverse rotation state, so as to drive the rotating arm to rotate; a limiting member, located on a side of the rotating arm, in which one end of the limiting member is combined with the combination member of the rotating arm, or one end of the limiting member is separated from the combination member through the rotation of the rotating arm; a second gear, located on the base of the rotating arm; and a third gear, driven by the second gear to rotate when the rotating arm rotates to a predetermined position, so that the third gear indirectly drives a paper pickup wheel to rotate.

The present invention also provides a paper pickup structure of a paper feeding device, which includes: a casing; a rotating arm, movably disposed on the casing, and including a connection portion, a base, and a combination member, in which the connection portion and the combination member are respectively located on two sides of the base; a first gear, combined with the connection portion and driven by a driving module to be switched between a forward rotation state and a reverse rotation state, so as to drive the rotating arm to rotate; a limiting member, including a fixed end and a free end, in which the fixed end is positioned on the casing, and the free end of the limiting member is combined with the combination member of the rotating arm, or the free end of the limiting member is separated from the combination member through the rotation of the rotating arm; a second gear, located on the base of the rotating arm; and a third gear, driven by the second gear to rotate when the rotating arm rotates to a predetermined position, so that the third gear indirectly drives a paper pickup wheel to rotate.

In the present invention, the limiting member is made of an elastic material; one end thereof is fixed at a preset position, and the other end thereof is combined with the combination member of the rotating arm when the rotating arm forwardly rotates to a first position and is separated from the combination member during the reverse rotation of the rotating arm, and afterwards, the rotating arm forwardly rotates, so that the second gear on the rotating arm drives the third gear to rotate, and the third gear drives the paper pickup wheel to rotate. Compared with the conventional paper pickup structure, the structure of the present invention is rather simple, and the components thereof are fewer, so that not only can the manufacturing cost of the components be reduced greatly, but the assembly cost thereof is also reduced, while no external component is required to control its operation, and the heat fade problem in the conventional paper pickup structure can be solved.

The preferred embodiments and efficacy of the present invention are described below with reference to the drawings.

BRIEF DESCRIPTION OF THE DRAWINGS

The present invention will become more fully understood from the detailed description given herein below for illustration only, and thus not limitative of the present invention, wherein.

DETAILED DESCRIPTION

Figure 1:
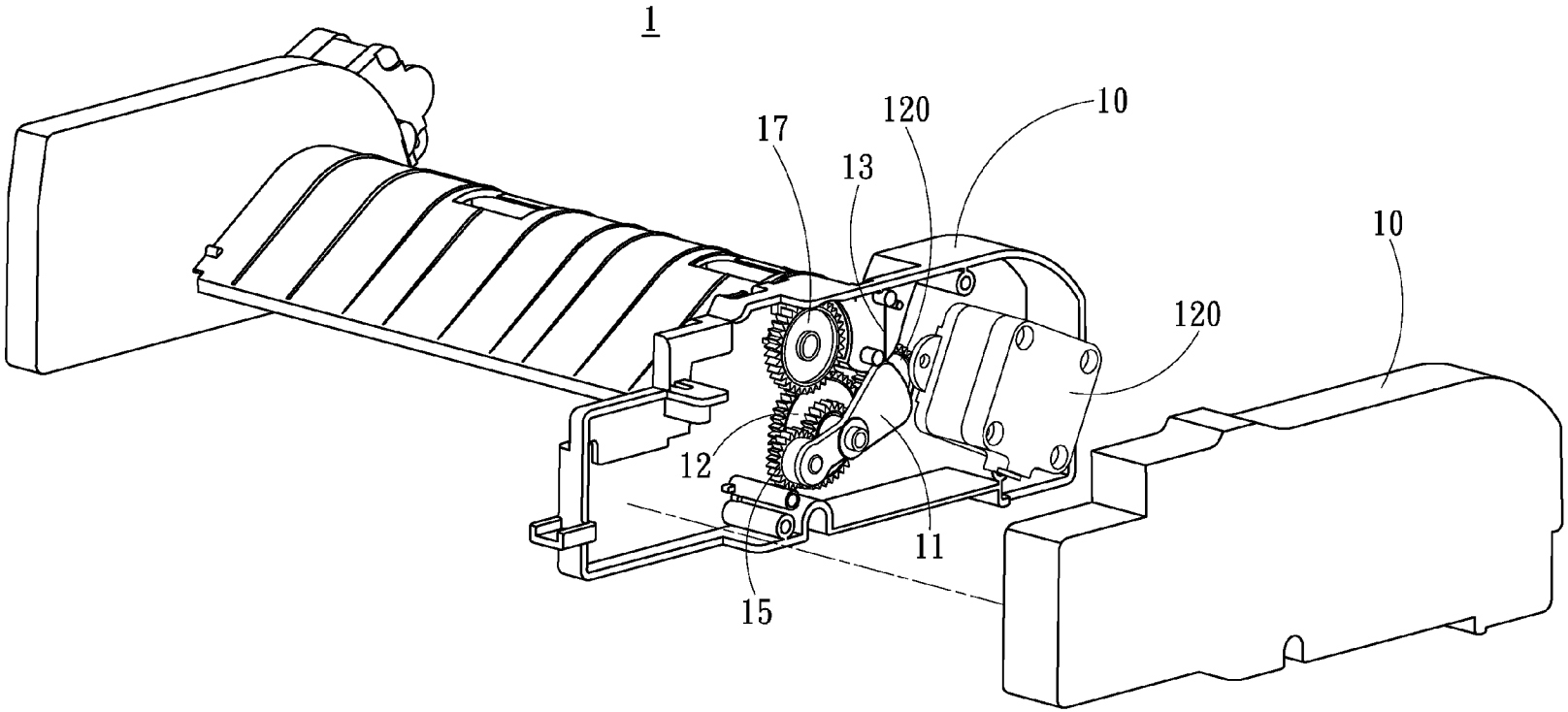
FIG. 1 is a schematic outside view of the present invention.

Please refer to FIGS. 1, 2, 3 and 4, in which a paper pickup structure of a paper feeding device according to the present invention is shown.

The paper pickup structure 1 of the paper feeding device includes a rotating arm 11, a first gear 12, a limiting member 13, a second gear 15, and a third gear 17.

Figure 2:
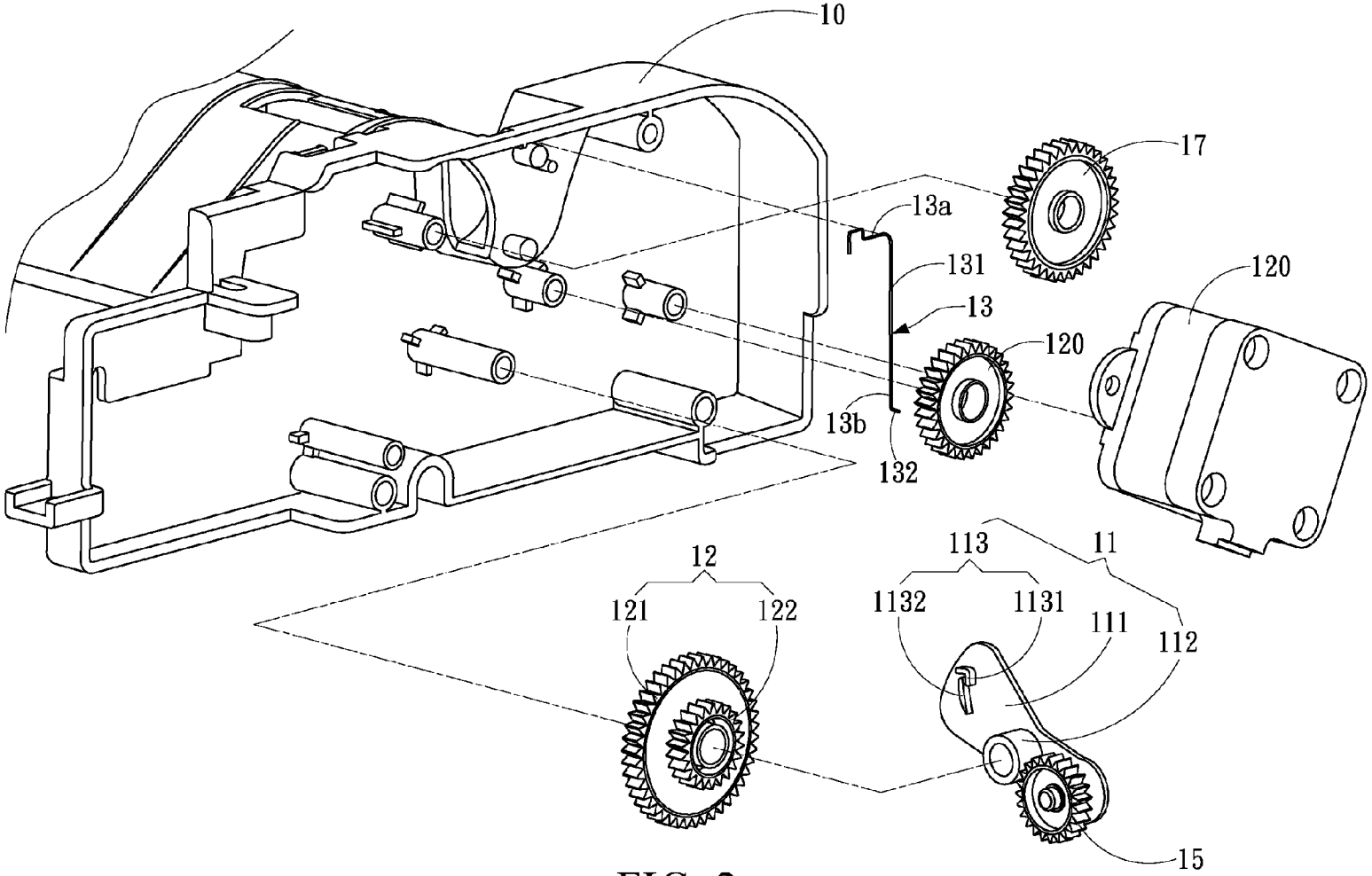
FIG. 2 is a schematic exploded view of the present invention.

The rotating arm 11 is mainly formed by a base 111, a connection portion 112, and a combination member 113. Herein, the base 111 is a long plate, the connection portion 112 and the combination member 113 are respectively located on two sides of the base 111, and the base 111 extends outward from a position where the combination member 113 is disposed, so that the base 111 is approximately in a J shape on the whole (as shown in FIG. 2), and the rotating arm 11 may rotate about the connection portion 112.

The first gear 12 is combined with the connection portion 112, and is driven by a driving module 120 to be switched between a forward rotation state and a reverse rotation state, so as to drive the rotating arm 11 to rotate. Herein, the driving module 120 may be a driving gear, but the present invention is not limited thereto; and the driving module 120 may also be a driving motor or other components capable of driving the first gear 12 to forwardly rotate or rotate in reverse.

In this embodiment, the first gear 12 has a primary gear portion 121 and a secondary gear portion 122, in which a root diameter of the primary gear portion 121 is greater than a root diameter of the secondary gear portion 122, and the secondary gear portion 122 is located on a side of the primary gear portion 121 and has the same center. Herein, the primary gear portion 121 may be engaged with the driving gear of the driving module 120, and the driving motor drives the driving gear to drive the first gear 12 to rotate. Such a structure is merely an example, and the present invention is not limited thereto.

Figure 3:
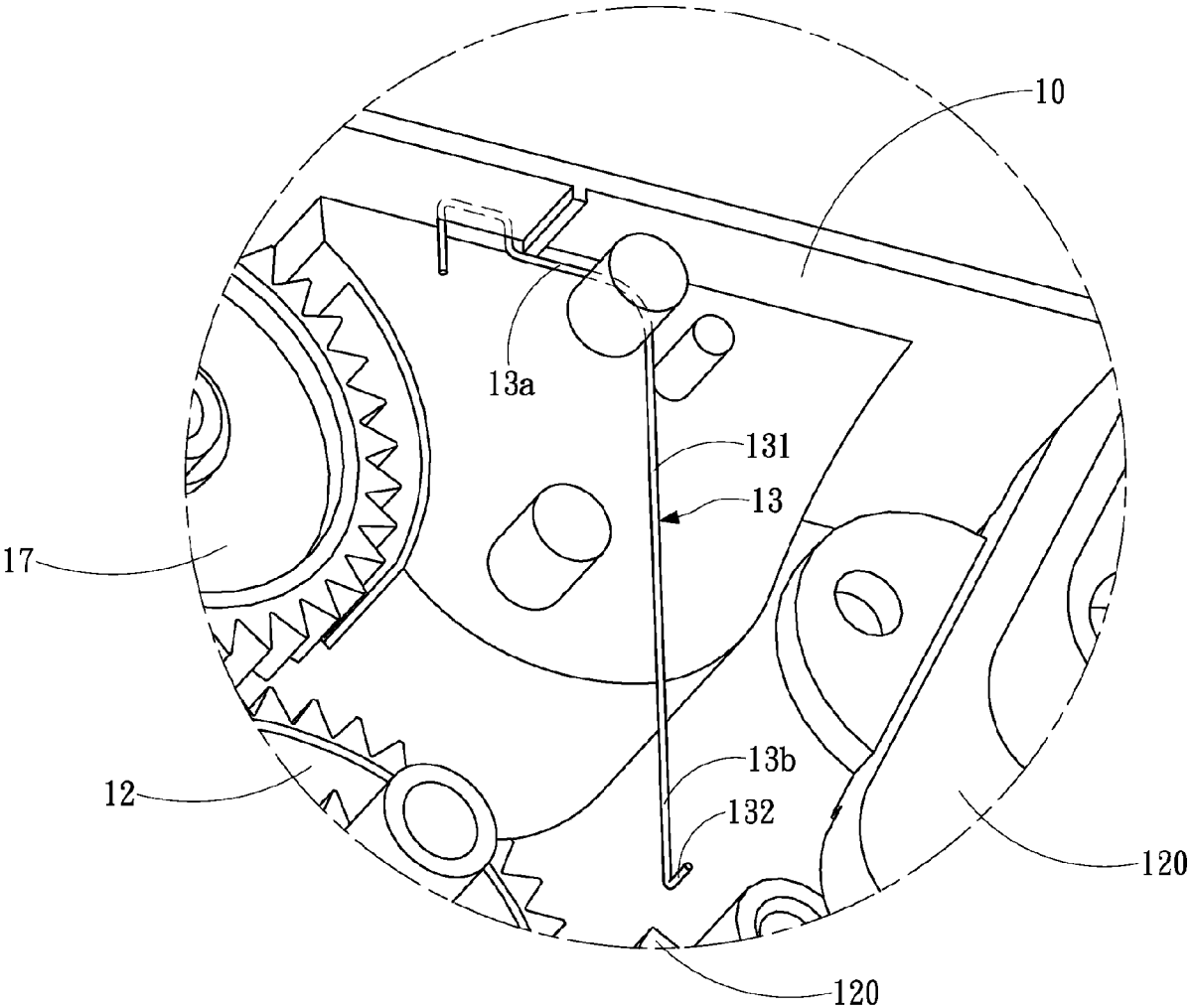
FIG. 3 is a schematic partial view (1) of the present invention.
Figure 4:
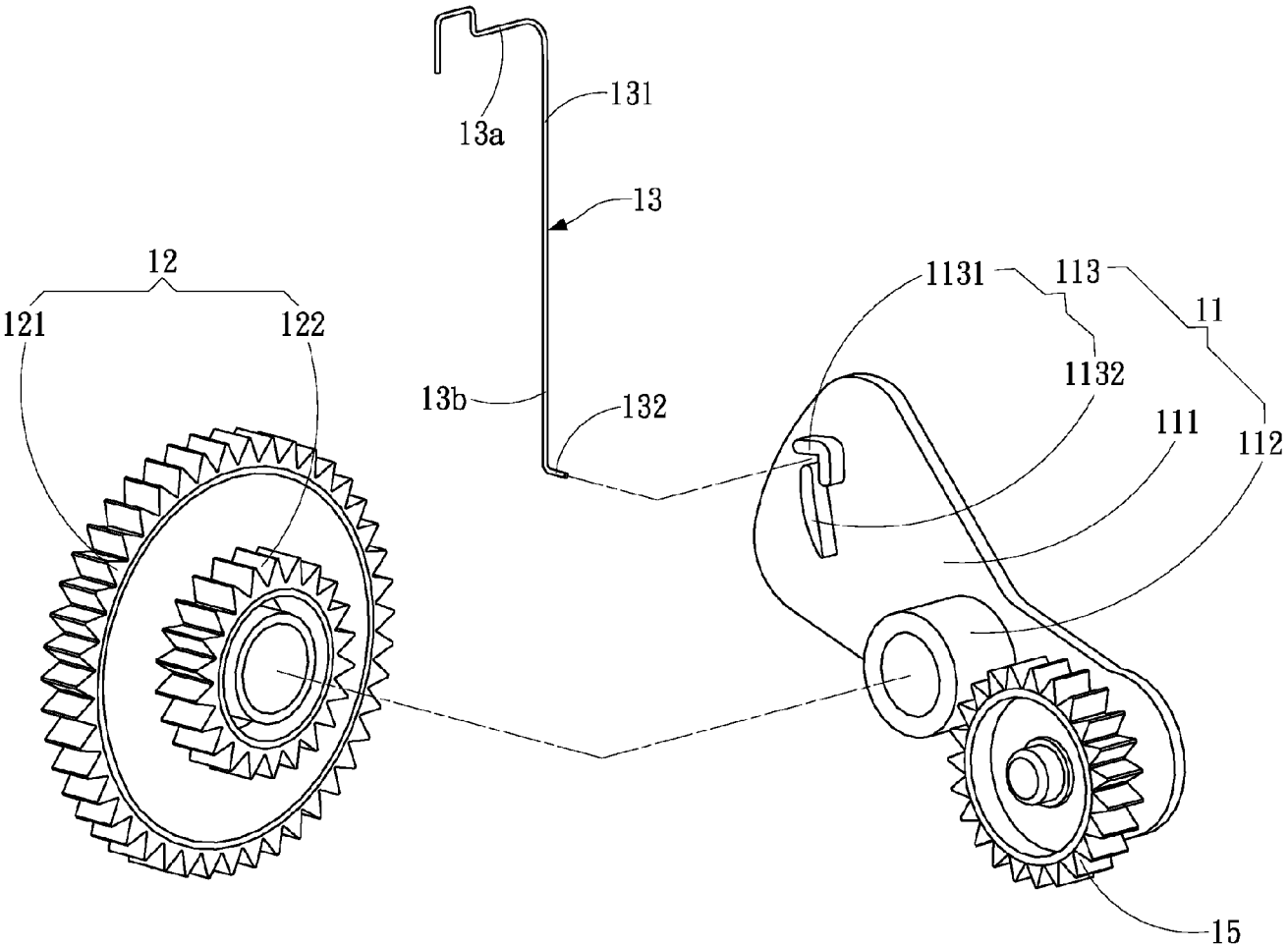
FIG. 4 is a schematic partial view (2) of the present invention.

The limiting member 13 is preferably made of an elastic material, and has a main body 131 and a pressing portion 132, an axial direction of the main body 131 is substantially parallel to the rotating arm 11, an axial direction of the pressing portion 132 is substantially vertical to the axial direction of the main body 131 (as shown in FIG. 3), and the limiting member 13 is approximately in an L shape on the whole. In addition, one end of the main body 131 is a fixed end 13*a*, and the other end of the main body 131 extends to form the pressing portion 132 and is a free end 13*b* accordingly, in which the fixed end 13*a* is fixed on a side of the rotating arm 11, and the free end 13*b* is closer to the combination member 113 of the rotating arm 11 than the fixed end 13*a* (as shown in FIG. 4). In this embodiment, the fixed end 13*a* is wound on a fixing member on the side of the rotating arm 11, so as to achieve the purpose of positioning the limiting member 13, but the present invention is not limited thereto; and the limiting member 13 may also be positioned by using an adhesive, a pin, or other fixing methods. Therefore, the free end 13*b* of the limiting member 13 is combined with the combination member 113 of the rotating arm 11, or the free end 13*b* of the limiting member 13 is separated from the combination member 113 through the rotation of the rotating arm 11.

The second gear 15 is a planetary gear structure located on the base 111 of the rotating arm 11, and a root diameter thereof is preferably smaller than the root diameter of the primary gear portion 121 of the first gear 12. The second gear 15 is engaged with the secondary gear portion 122. If a force of the driving module 120 for driving the first gear 12 is smaller than friction of the secondary gear portion 122 for engaging the second gear 15, the first gear 12 drives the rotating arm 11 to rotate; on the contrary, if the force of the driving module 120 for driving the first gear 12 is greater than the friction of the secondary gear portion 122 for engaging the second gear 15, the first gear 12 drives the second gear 15 to rotate.

In this embodiment, the combination member 113 of the rotating arm 11 is mainly formed by a combination portion 1131 and a guiding portion 1132. The guiding portion 1132 guides the free end 13*b* of the limiting member 13 to be combined with the combination portion 1131. Herein, the guiding portion 1132 is an arc-shaped strip structure and is closer to the second gear 15 than the combination portion 1131, and an arc surface thereof protrudes toward the second gear 15; and the combination portion 1131 is an L-shaped protruding structure, and an inner opening thereof faces the guiding portion 1132. Herein, the structures of the combination portion 1131 and the guiding portion 1132 are merely examples, and the present invention is not limited thereto.

As for the third gear 17, when the rotating arm 11 rotates to a predetermined position, the second gear 15 is engaged with the third gear 17, and drives the third gear 17 to rotate, so that the third gear 17 may indirectly drive a paper pickup wheel (not shown), to rotate.

The present invention further includes a casing 10 which may be a housing of the paper feeding device for disposing other components required by the paper feeding device. Herein, the rotating arm 11 may be movably disposed on the casing 10, so that the rotating arm 11 may rotate relative to the casing 10; and the fixed end 13*a* of the main body 131 of the limiting member 13 is positioned on the casing 10, or the casing 10 directly extends to form the fixing member, so that the fixed end 13*a* of the limiting member 13 is wound on the fixing member, so as to achieve the purpose of positioning the limiting member 13.

Figure 5A:
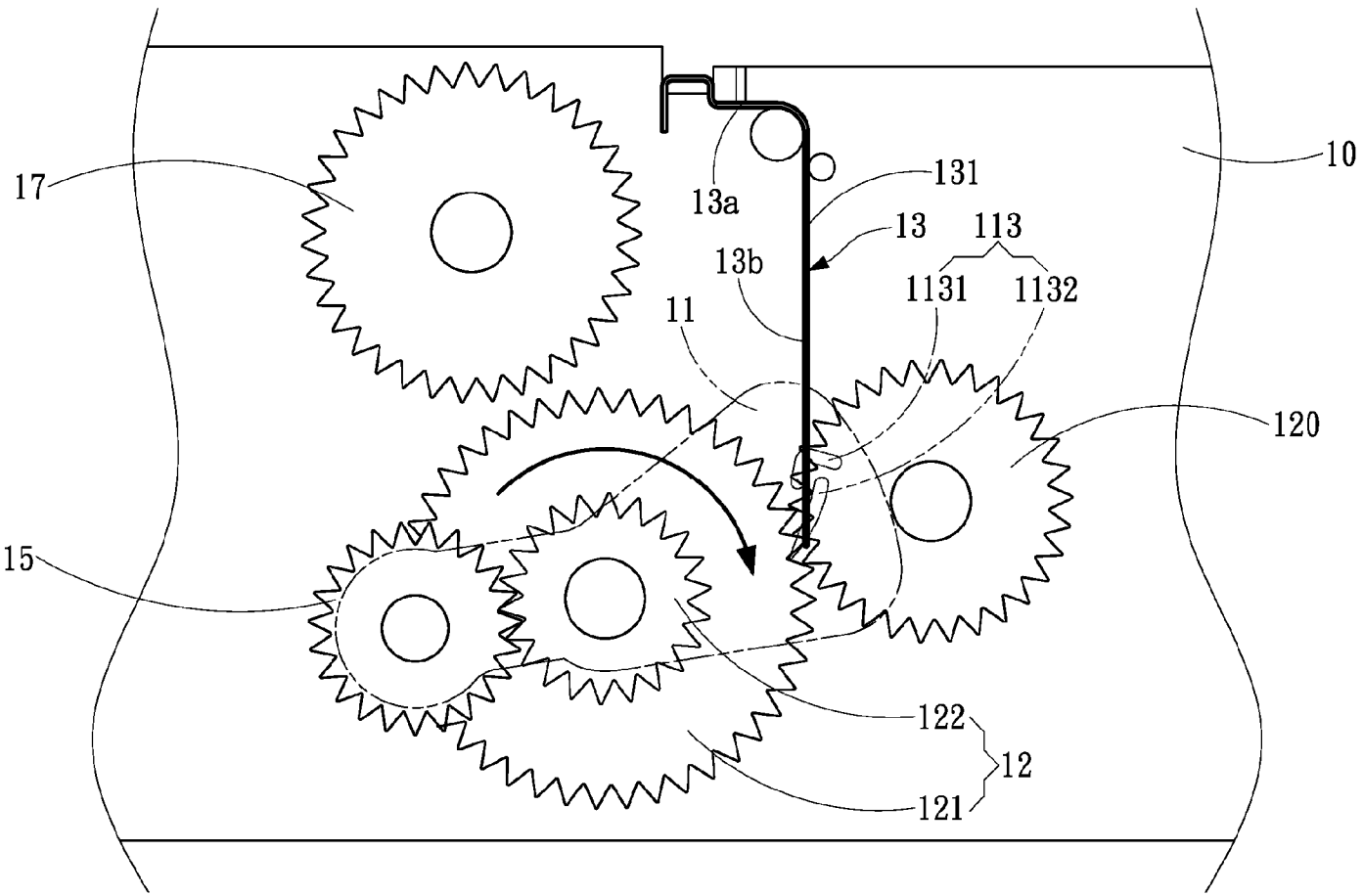
FIG. 5A is a schematic view (1) illustrating an operation of the present invention.
Figure 5B:
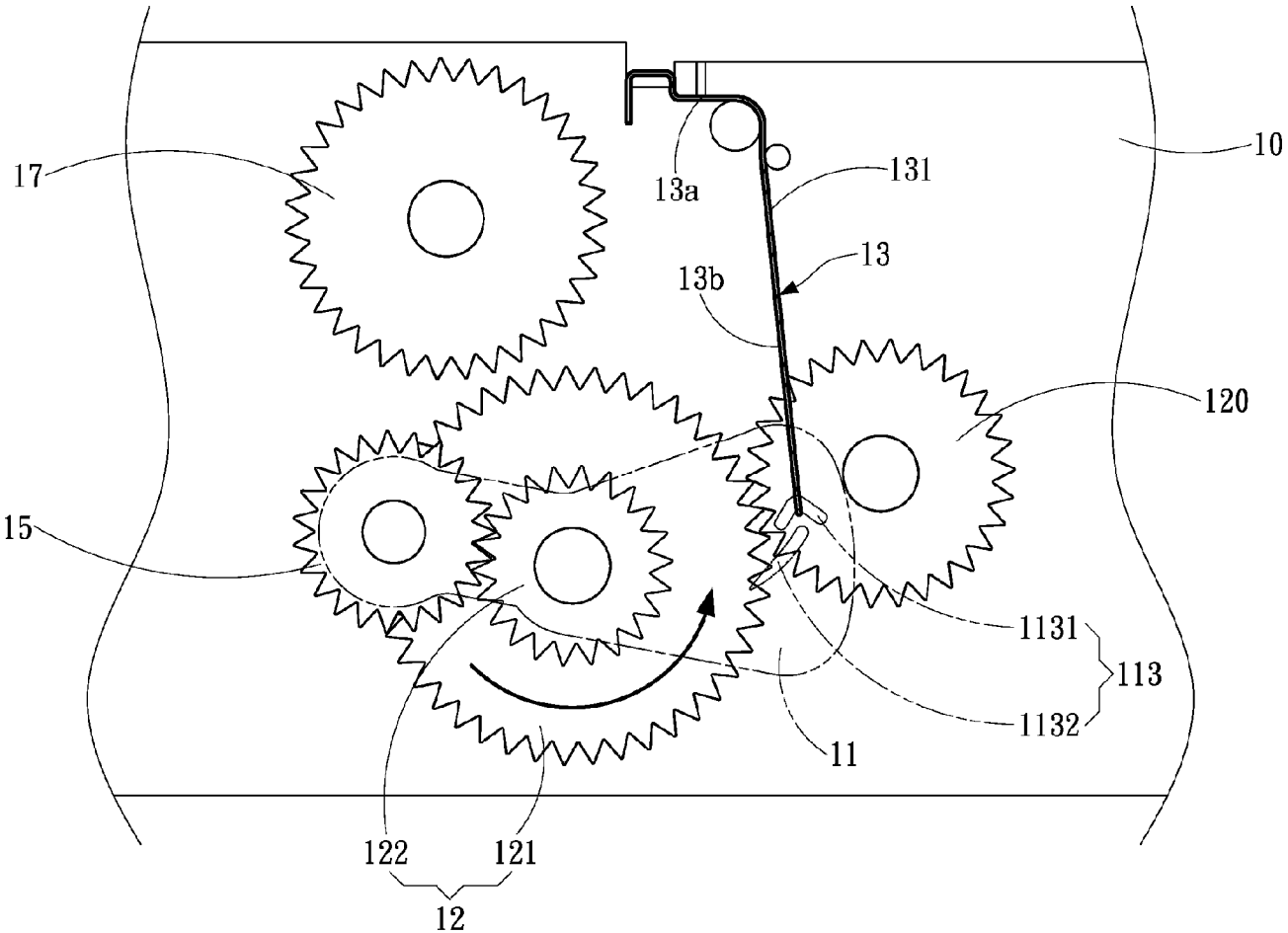
FIG. 5B is a schematic view (2) illustrating an operation of the present invention.
Figure 6B:
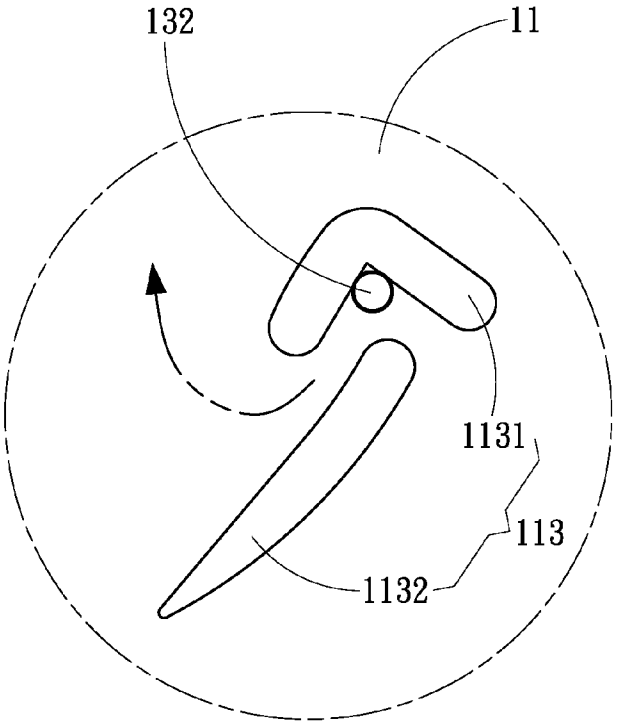
FIG. 6B is a schematic view (2) illustrating an operation of the present invention from another viewing angle.
Figure 6A:
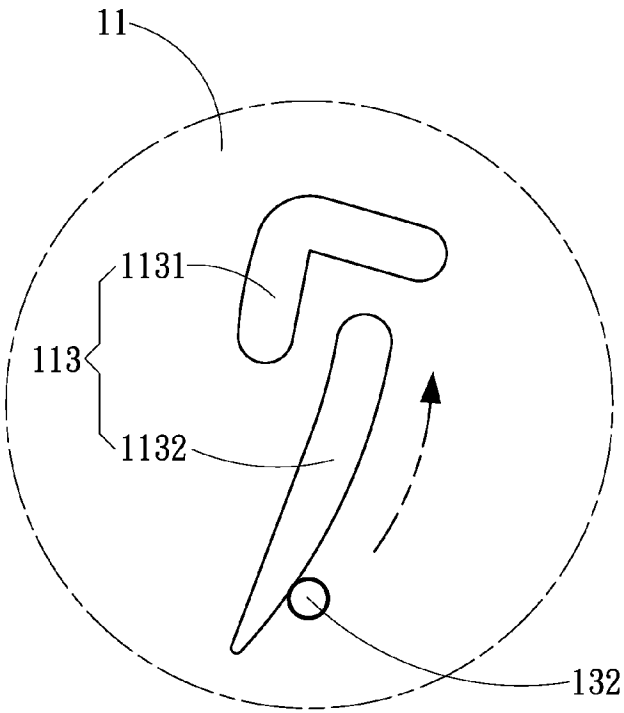
FIG. 6A is a schematic view (1) illustrating an operation of the present invention from another viewing angle.

Referring to FIGS. 5A and 5B, the driving module 120 drives the first gear 12 to forwardly rotate, so that the first gear 12 is in the forward rotation state, and due to the friction of the secondary gear portion 122 of the first gear 12 for engaging the second gear 15, the rotating arm 11 forwardly rotates and moves to a first position with the forward rotation of the first gear 12 (as shown in FIG. 5B). Referring to FIGS. 6A and 6B, during the process of the rotating arm 11 rotating to the first position, the pressing portion 132 of the limiting member 13 moves along the arc surface of the guiding portion 1132, passes through the guiding portion 1132, and then is positioned in the combination portion 1131, so that the rotating arm 11 is positioned at the first position. Afterwards, the first gear 12 continues forwardly rotating, and the rotating arm 11 no longer rotates, and the secondary gear portion 122 of the first gear 12 may therefore drive the second gear 15 to rotate.

Referring to FIGS. 5B and 6B, the driving module 120 drives the first gear 12 to rotate in reverse to switch the first gear 12 to the reverse rotation state, and due to the friction of the secondary gear portion 122 of the first gear 12 for engaging the second gear 15, the rotating arm 11 rotate in reverses with the first gear 12, and the pressing portion 132 of the limiting member 13 is separated from the combination portion 1131.

Figure 5C:
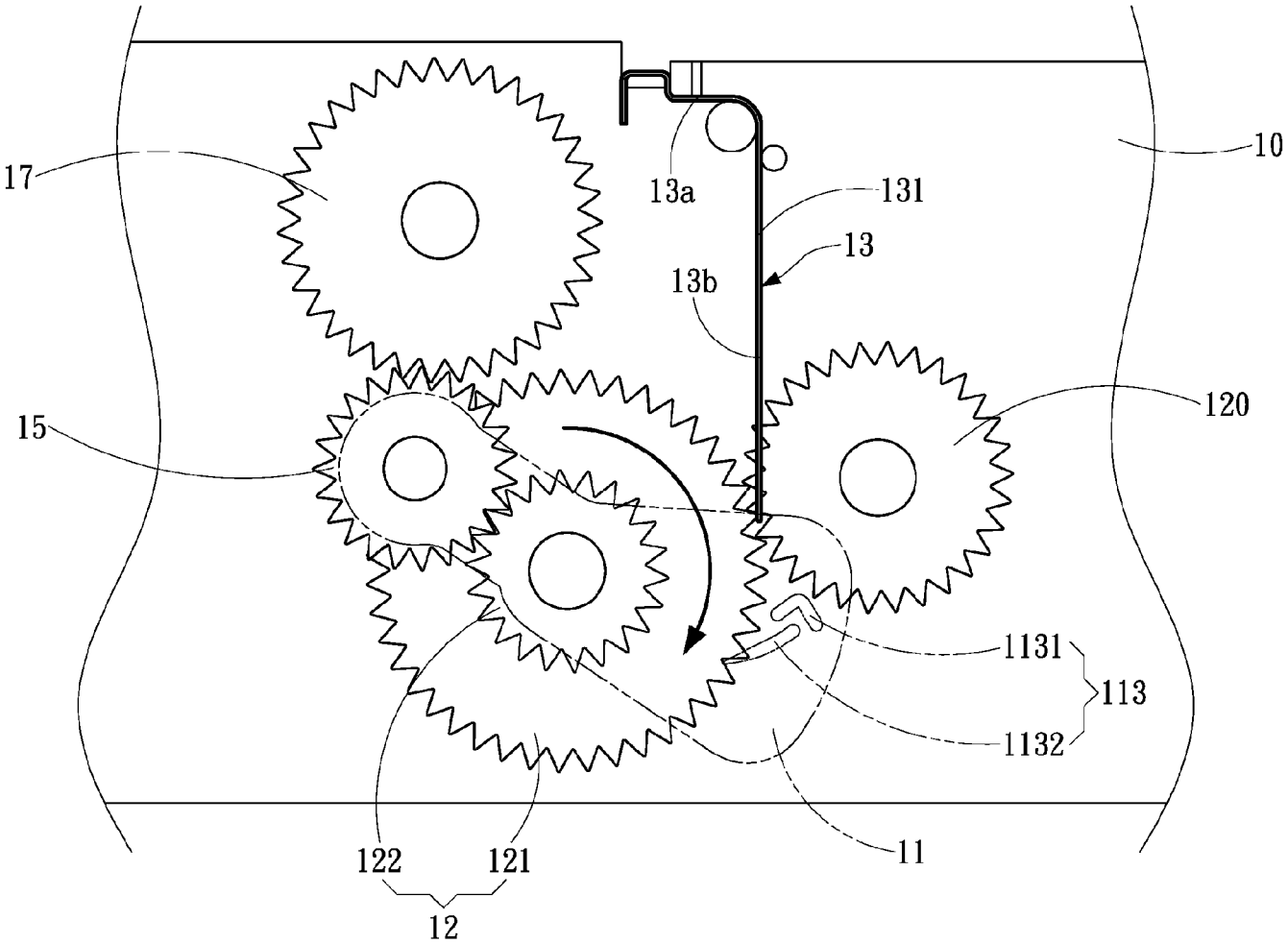
FIG. 5C is a schematic view (3) illustrating an operation of the present invention.
Figure 5D:
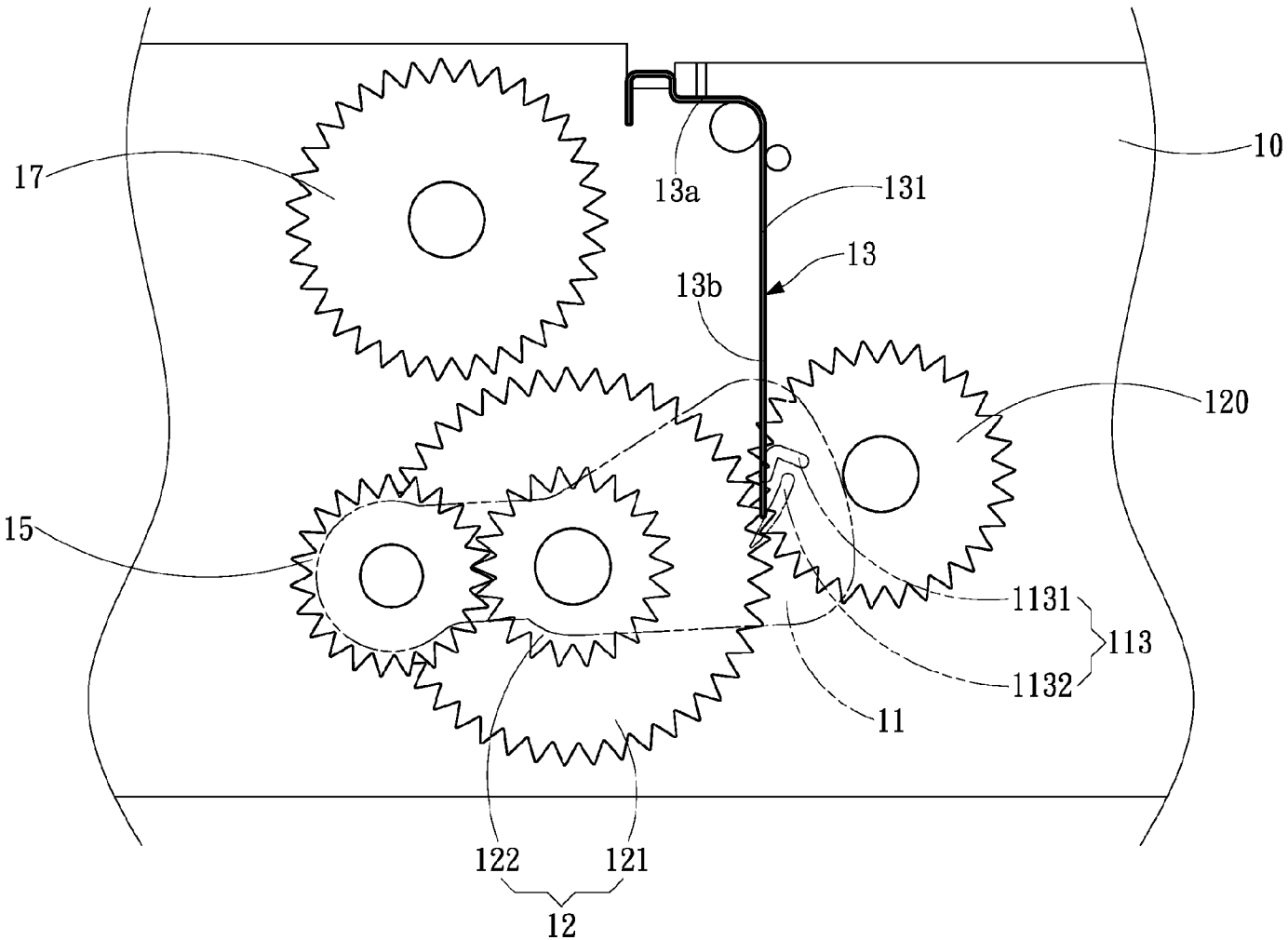
FIG. 5D is a schematic view (4) illustrating an operation of the present invention.
Figure 6D:
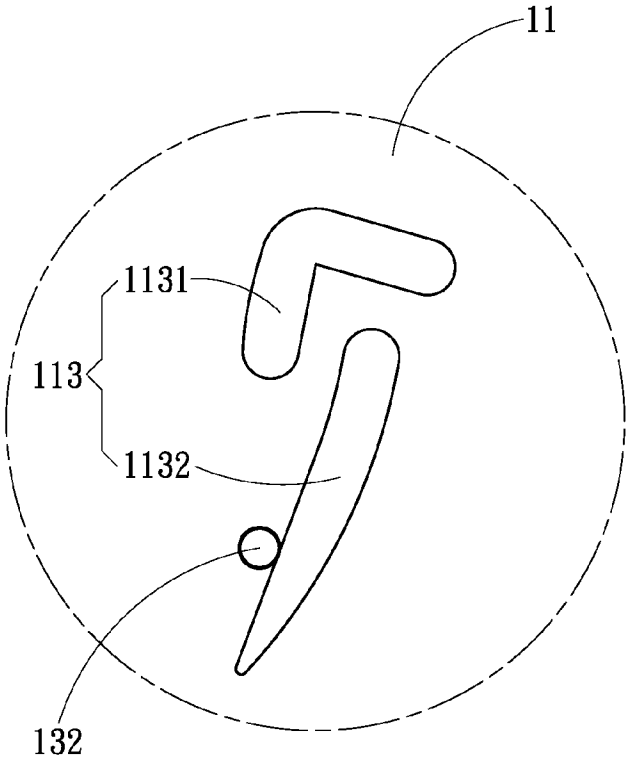
FIG. 6D is a schematic view (4) illustrating an operation of the present invention from another viewing angle.
Figure 6C:
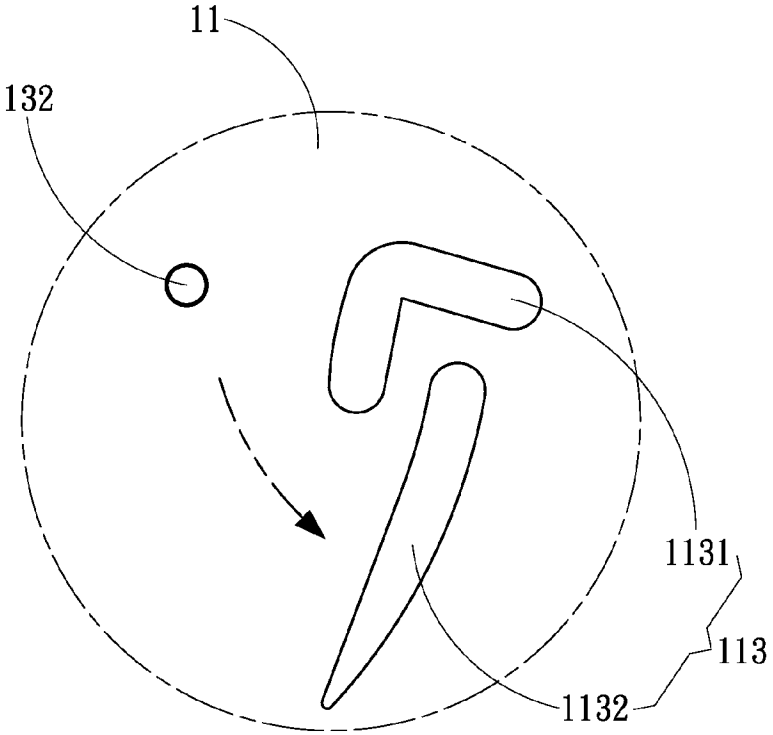
FIG. 6C is a schematic view (3) illustrating an operation of the present invention from another viewing angle.

Referring to FIGS. 5C and 6C, the driving module 120 again drives the first gear 12 to forwardly rotate to switch the first gear 12 to the forward rotation state. Since the pressing portion 132 of the limiting member 13 is already separated from the combination portion 1131, the rotating arm 11 may forwardly rotate from the first position to a second position (that is, the predetermined position, as shown in FIG. 5C), and after the rotating arm 11 moves to the second position, the secondary gear portion 122 of the first gear 12 may drive the second gear 15 to rotate and the second gear 15 drives the third gear 17 to rotate, so that the third gear 17 may indirectly drive the paper pickup wheel (not shown), to rotate, thereby achieving the purpose of controlling the paper pickup of the paper pickup wheel. Referring to FIGS. 5D and 6D, the driving module 120 again drives the first gear 12 to forwardly rotate to switch the first gear 12 to the reverse rotation state, the rotating arm 11 is driven to rotate, and the pressing portion 132 of the limiting member 13 moves along the arc surface of the guiding portion 1132, and thus the state shown in FIGS. 5A and 6A may be restored.

In the present invention, the limiting member is made of an elastic material to control the rotation position of the rotating arm. Compared with the conventional paper pickup structure, the present invention does not need elements such as a torsional spring clutch, and thus has a rather simple structure and fewer components, so that not only the manufacturing cost of the components is greatly reduced, but also the assembly cost is reduced, and an assembly process is simplified by reducing the number of the components, and meanwhile the efficiency and yield rate of the assembly work are effectively improved. Furthermore, the present invention does not require any external component to control its operation, and the heat fade problem in the conventional paper pickup structure can be solved at the same time.

While the present invention has been described by the way of example and in terms of the preferred embodiments, it is to be understood that the invention need not to be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A paper pickup structure of a paper feeding device, comprising:

a rotating arm, comprising a connection portion, a base, and a combination member, wherein the connection portion and the combination member are respectively located on two ends of the base, and the combination member comprises a combination portion and a guiding portion;

a first gear, combined with the connection portion and driven by a driving module to be switched between a forward rotation state and a reverse rotation state, so as to drive the rotating arm to rotate;

a limiting member, located on a side of the rotating arm, wherein the guiding portion guides one end of the limiting member to be combined with the combination portion of the combination member of the rotating arm and to be located between the combination portion and the guiding portion of the combination member, and said one end of the limiting member is separated from the combination member through rotation of the rotating arm;

a second gear, located on the base of the rotating arm; and a third gear, driven by the second gear to rotate when the rotating arm rotates to a predetermined position, so that the third gear drives a portion of the paper pickup structure to rotate.

2. The paper pickup structure of a paper feeding device according to claim 1, wherein the limiting member comprises a main body and a pressing portion, and an axial direction of the pressing portion is substantially perpendicular to an axial direction of the main body.

3. The paper pickup structure of a paper feeding device according to claim 2, wherein the first gear drives the rotating arm to forwardly rotate to a first position in the forward rotation state, so that the pressing portion of the limiting member is combined with the combination member of the rotating arm, the first gear drives the rotating arm to rotate in reverse in the reverse rotation state, so that the pressing portion is separated from the combination member, then the first gear is switched to the forward rotation state to drive the rotating arm to forwardly rotate to a second position, and the second position is the predetermined position.

4. The paper pickup structure of a paper feeding device according to claim 1, wherein the first gear comprises a primary gear portion and a secondary gear portion, the secondary gear portion is located on a side of the primary gear portion and is engaged with the second gear, if a force of the driving module for driving the first gear is smaller than friction of the secondary gear portion for engaging the second gear, the first gear drives the rotating arm to rotate, and if the force of the driving module for driving the first gear is greater than the friction of the secondary gear portion for engaging the second gear, the first gear drives the second gear to rotate.

5. A paper pickup structure of a paper feeding device, comprising:

a casing;

a rotating arm, movably disposed on the casing and comprising a connection portion, a base, and a combination member, wherein the connection portion and the combination member are respectively located on two ends of the base, and the combination member comprises a combination portion and a guiding portion;

a first gear, combined with the connection portion and driven by a driving module to be switched between a forward rotation state and a reverse rotation state, so as to drive the rotating arm to rotate;

a limiting member, comprising a fixed end and a free end, wherein the fixed end is positioned on the casing, and the guiding portion guides the free end of the limiting member to be combined with the combination portion of the combination member of the rotating arm and to be located between the combination portion and the guiding portion of the combination member and the free end of the limiting member is separated from the combination member through rotation of the rotating arm;

a second gear, located on the base of the rotating arm; and a third gear, driven by the second gear to rotate when the rotating arm rotates to a predetermined position, so that the third gear drives a portion of the paper pickup structure to rotate.

6. The paper pickup structure of a paper feeding device according to claim 5, wherein the first gear comprises a primary gear portion and a secondary gear portion, the secondary gear portion is located on a side of the primary gear portion and is engaged with the second gear, if a force of the driving module for driving the first gear is smaller than friction of the secondary gear portion for engaging the second gear, the first gear drives the rotating arm to rotate, and if the force of the driving module for driving the first gear is greater than the friction of the secondary gear portion for engaging the second gear, the first gear drives the second gear to rotate.

7. The paper pickup structure of a paper feeding device according to claim 5, wherein the limiting member comprises a main body and a pressing portion, and an axial direction of the pressing portion is substantially vertical to an axial direction of the main body.

8. The paper pickup structure of a paper feeding device according to claim 7, wherein the first gear drives the rotating arm to forwardly rotate to a first position in the forward rotation state, so that the pressing portion of the limiting member is combined with the combination member of the rotating arm, the first gear drives the rotating arm to rotate in reverse in the reverse rotation state, so that the pressing portion is separated from the combination member, then the first gear is switched to the forward rotation state to drive the rotating arm to forwardly rotate to a second position, and the second position is the predetermined position.

* * * * *